US007008317B2

(12) United States Patent
Cote et al.

(10) Patent No.: US 7,008,317 B2
(45) Date of Patent: Mar. 7, 2006

(54) COMPUTER GAMBLING GAME

(75) Inventors: Harold Cote, Quebec (CA); Stephan Giard, Quebec (CA)

(73) Assignee: INGENIO, Filiale De Loto-Quebec Inc., Montreal (CA)

( * ) Notice: Subject to any disclaimer, the term of this patent is extended or adjusted under 35 U.S.C. 154(b) by 679 days.

(21) Appl. No.: 09/891,875

(22) Filed: Jun. 25, 2001
(Under 37 CFR 1.47)

(65) Prior Publication Data

US 2002/0090986 A1 Jul. 11, 2002

Related U.S. Application Data

(63) Continuation of application No. PCT/CA99/01228, filed on Dec. 20, 1999.

(30) Foreign Application Priority Data

Dec. 23, 1998 (CA) ..... 2258809

(51) Int. Cl.
*A63F 9/24* (2006.01)

(52) U.S. Cl. ..... 463/16

(58) Field of Classification Search ..... 463/16–22, 463/25, 30, 42–43
See application file for complete search history.

(56) References Cited

U.S. PATENT DOCUMENTS

| | | | | |
|---|---|---|---|---|
| 4,332,389 | A | 6/1982 | Loyd, Jr. et al. | 273/237 |
| 4,582,324 | A | 4/1986 | Koza et al. | 273/138 |
| 4,815,741 | A | 3/1989 | Small | 273/138 |
| 4,937,853 | A | 6/1990 | Brule et al. | 379/96 |
| 4,996,705 | A | 2/1991 | Entenmann et al. | 379/91 |
| 5,110,129 | A | 5/1992 | Alvarez | 273/138 |
| 5,212,368 | A | 5/1993 | Hara | 235/375 |
| 5,231,568 | A | 7/1993 | Cohen et al. | 364/401 |
| 5,327,485 | A | 7/1994 | Leaden | 379/95 |
| 5,342,047 | A | 8/1994 | Heidel et al. | 273/85 |
| 5,346,258 | A | 9/1994 | Behm et al. | 283/102 |
| 5,377,975 | A | 1/1995 | Clapper, Jr. | 273/138 |
| 5,532,046 | A | 7/1996 | Rich et al. | 428/202 |
| 5,569,082 | A | 10/1996 | Kaye | 462/17 |
| 5,569,512 | A | 10/1996 | Brawner et al. | 428/29 |

(Continued)

FOREIGN PATENT DOCUMENTS

WO 96/31832 10/1996

(Continued)

OTHER PUBLICATIONS

US 5,823,877, 10/1998, Scagnelli et al. (withdrawn)

*Primary Examiner*—Kim Nguyen
(74) *Attorney, Agent, or Firm*—Darby & Darby

(57) ABSTRACT

A computer gambling game is disclosed herein. The computer gambling game includes a computer program to provide a plurality of sequences of game states, each leading to a game outcome. A game seed is required by the computer program to generate one of the sequences of game states. Each game seed corresponds to one of the sequences of game states. The program can be acquired in the form of a computer-readable medium, such as a CD-ROM. To play the computer game, a player must also acquire an initiator code that can either be printed on an instant play lottery ticket or distributed via a computer network. The initiator code corresponds to one of the game seeds. The computer program uses a look-up table to retrieve the game seed that corresponds to the initiator code and to provide the corresponding sequence of game states that will lead to the outcome. Some outcomes lead to gains.

34 Claims, 3 Drawing Sheets

U.S. PATENT DOCUMENTS

| | | | | |
|---|---|---|---|---|
| 5,595,538 | A | 1/1997 | Haste, III | 463/17 |
| 5,628,684 | A | 5/1997 | Bouedec | 463/17 |
| 5,709,603 | A * | 1/1998 | Kaye | 463/17 |
| 5,779,545 | A | 7/1998 | Berg et al. | |
| 5,791,990 | A * | 8/1998 | Schroeder et al. | 463/17 |
| 5,805,784 | A | 9/1998 | Crawford | 395/173 |
| 5,816,918 | A | 10/1998 | Kelly et al. | 463/16 |
| 5,816,919 | A | 10/1998 | Scagnelli et al. | 463/25 |
| 2004/0166942 | A1 * | 8/2004 | Muir | 463/43 |

FOREIGN PATENT DOCUMENTS

| | | |
|---|---|---|
| WO | 97/02073 | 1/1997 |
| WO | 98/56474 | 12/1998 |

* cited by examiner

COMPUTER GAMBLING GAME

This is a continuation of international application Ser. No. PCT/CA99/01228, filed Dec. 20, 1999, the entire disclosure of which is hereby incorporated by reference.

FIELD OF THE INVENTION

The present invention relates to gambling games More specifically, the present invention is concerned with a gambling game to be played on a personal computer.

BACKGROUND OF THE INVENTION

Gambling games are conventionally controlled by an operator, such as, for example, a lottery corporation To ensure the integrity of the game and to eliminate any possibility of fraud, the operator foresees every aspect of the game, such as: collecting the wagers, issuing tickets or receipts, executing the draw, paying the winners, etc Examples of such games include: traditional lotteries, instant play lotteries (also called "scratch & win" lotteries), casino games and video lotteries.

The increasing performance and popularity of personal computers have brought new possibilities for gambling games. However, the main issue when using a personal computer for implementing a gambling game is the game integrity. Indeed, since the lottery corporation has no direct control over the hardware and software of the player's personal computer, other means for maintaining game integrity are required.

Solutions to this problem have been proposed by Kaye in two related United States patents both entitled "Personal Computer Lottery Game": U.S. Pat. No. 5,569,082, issued on Oct. 29, 1996 and U.S. Pat. No. 5,709,603 issued on Jan. 20, 1998. Although these documents disclose the use of a code printed on a lottery ticket to play a lottery game on a personal computer, they do not disclose sufficient means to ensure the integrity of the game.

Another drawback of Kaye's game is that the code only provides information about the outcome of the game. Since all the codes that correspond to a winning outcome are likely to produce an identical game for the player, the player's enjoyment of the game is decreased by the game's predictability.

OBJECTS OF THE INVENTION

An object of the present invention is therefore to provide a secure personal computer gambling game.

Another object of the present invention is to provide a personal computer gambling game, wherein the use of a code provides information related to both the outcome and workflow of the game.

SUMMARY OF THE INVENTION

More specifically, in accordance with the present invention, there is provided a computer gambling game comprising:

a computer program including a plurality of sequences of game states; each sequence of game states leading to a predetermined game outcome, at least one of the game outcomes corresponding to gains;

a look-up table including a plurality of game seeds, each game seed being related to one of the plurality of sequences of game states; and at least one initiator code to be input into the computer program; each initiator code being related to one of the plurality of game seeds;

whereby, in operation, a) the computer program is provided with one of at least one initiator code; b) the computer program retrieves in the look-up table a game seed that corresponds to the provided initiator code; and c) the computer program executes the sequence of game states that corresponds to the retrieved game seed and provides the predetermined game outcome corresponding to the retrieved game seed According to another aspect of the present invention, there is providing a method for generating a computer gambling game initiated by an inputted initiator code, comprising:

determining the number and nature of game outcomes; at least one of the determined game outcomes corresponding to gains;

for each determined game outcome, determining a sequence of game states according to the inputted initiator code;

programming a computer game to selectively execute one of the sequences of game states; and generating a plurality of game seeds; each game seed corresponding to one of the sequences of game states and storing each game seed in a look-up table.

According to still another aspect of the present invention, there is providing a method for playing a computer gambling game comprising:

acquiring a computer program that provides a plurality of sequences of game states; each of the sequences of game states leading to a predetermined game outcome; at least one of the game outcomes corresponding to gains;

acquiring an initiator code corresponding to one of the sequences of game states;

installing the computer program on a personal computer;

running the computer program; and inputting the initiator code in the computer program; the computer program using the initiator code to select one of the sequences of game states that corresponds to the initiator code; said computer program executing the selected sequence of game states to yield a corresponding game outcome.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENTS

According to the present invention, there is provided a gambling game to be played on a personal computer. In order to play the computer gambling game of the present invention, the player must first acquire an initiator code and a computer program that embodies the computer gambling game. The initiator code is required by the computer program to play the game and provides information on both the outcome of the game and its workflow.

More specifically, the computer program (hereinbelow also referred to as "computer game") is optionally interactive and provides the player with a sequence of game states. The sequence of game states (also referred to as the "workflow") is a series of states that are computed by the computer game according to the initiator code and the choices of the player. This sequence leads the player from the beginning of the game to its final outcome, also set by the initiator code.

A lottery based on a computer gambling game according to the present invention allows the operator to control the number and nature of gains by issuing the adequate initiator codes. The present invention advantageously allows the implementation of numerous gambling games to be played on a personal computer, without any prejudice to the integrity of the games.

Figure 1:
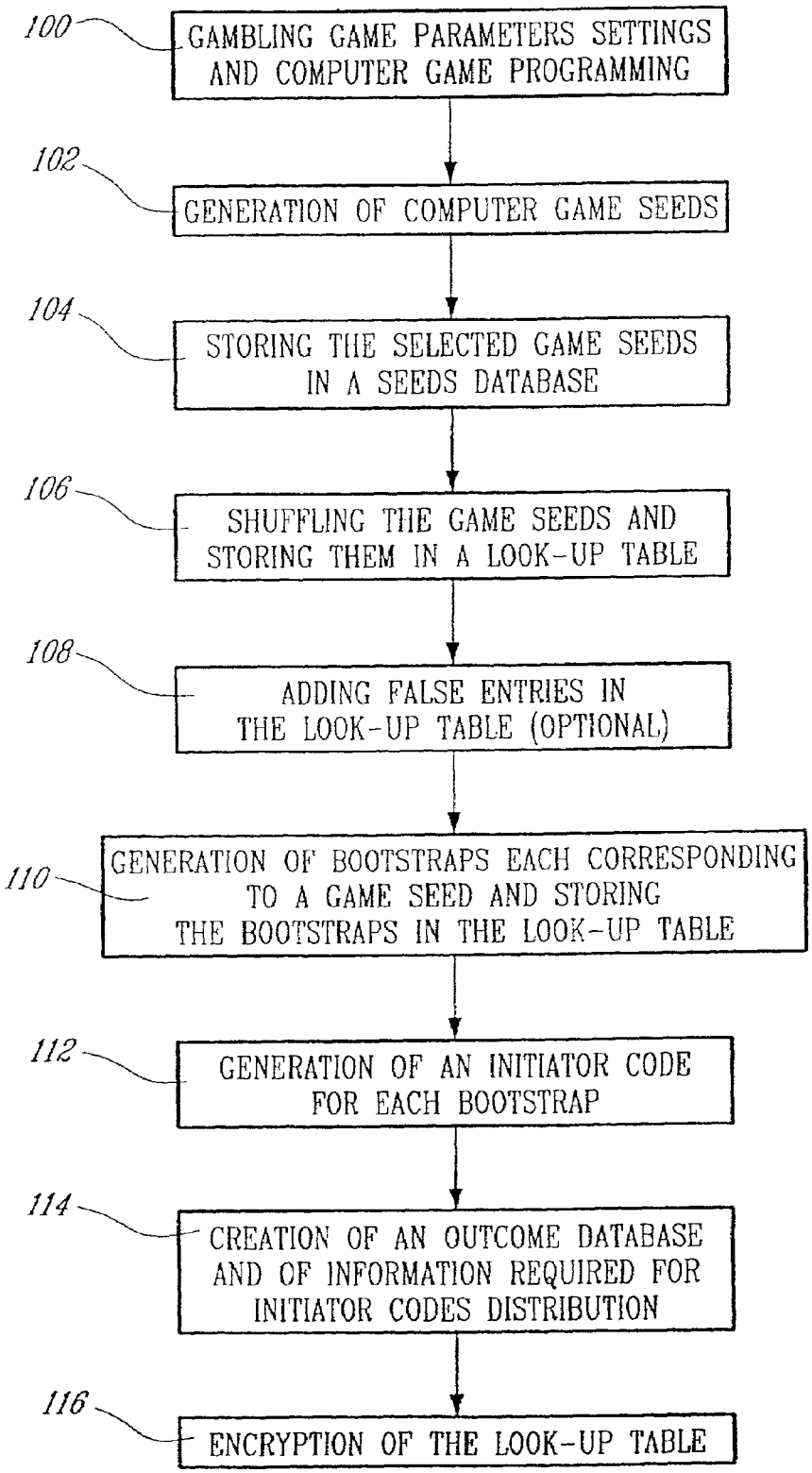
FIG. 1 is a block diagram illustrating a method to generate a computer gambling game according to an embodiment of the present invention.

FIG. 1 of the appended drawings illustrates a method to generate a computer gambling game according to an embodiment of the present invention.

As it is believed obvious to someone of ordinary skills in the art, the present computer gambling game, like any lottery, cannot be generated without first establishing certain parameters such as, for example, the number of initiator codes (or games) to be sold and the number and nature of the game outcomes (gains). These parameters are set in step 100 and stored in a computer-readable parameters database.

Step 100 also includes the overall design and programming parameters of the computer program that embodies the game. The computer game can take many forms, such as, for example, arcade games, adventure games and conventional casino simulation games. The computer game must be so programmed as to accept a set of parameters that will allow a plurality of sequences of states for each game played. This diversity is advantageous to keep the player's interest from game to game, and to eliminate the chance of the player guessing the final outcome of the game. To achieve this objective, the invention provides a computer game engine, i.e. a part of the computer program that is responsible for the linking of the game states, that is based on a pseudo-random generator. Starting with a game seed, indirectly obtained from the initiator code, as will be detailed later, the game engine generates a sequence of pseudo-random values that are then interpreted against the parameters of the game to output each state of the game.

Other characteristics and functions of the computer program that embodies the game will become apparent upon reading the following description.

In step 102, game seeds are randomly generated using traditional programming methods and fed to the computer game engine.

For each seed fed to the computer game engine, a simulated sequence of game states is produced. Each result obtained is then compared to the parameters predetermined in step 100.

Each time the outcome and the sequence of game states correspond to a desired value in the parameters database, the corresponding game seed-outcome pair is stored in a computer-readable seeds database (step 104).

When all the required game seeds, as specified by the parameters predetermined in step 100, have been generated and stored in the seeds database, the game seed-outcome pair are shuffled and stored, as entries, in a look-up table (step 106). The shuffling of the seed-outcome pairs prevents any individual, even someone familiar with the details of step 102, to figure out the sequence of seeds in the table. Alternatively, a binary value identifying the gains that correspond to each outcome can be stored in the look-up table instead of the explicit description of the outcome. This will save space in the table.

It is to be noted that the storing of the outcome in the look-up table is optional. However, as will be explained hereinbelow, the presence of the outcome in the look-up table will provide an additional way of increasing the integrity of the game.

Optionally, false entries, in the form of randomly generated strings of bits, can be inserted in the look-up table (step 108) to increase its protection against decoding by an individual trying to obtain the valid content of the table. This kind of attack would have for objective to obtain valid game seeds to play for free, which could be considered a major commercial drawback for the game even though no fraud is actually committed. As will become more apparent with the other protection measures described later, it is an objective of the invention to provide protection against computer hacking.

In step 110, a bootstrap generation technique and a one way algorithm are used to find a bootstrap for each valid game seed-outcome pair in the look-up table. Bootstraps are values that, when fed to a one way algorithm, will yield an index value, i.e. the relative position of a game seed-outcome pair entry in the look-up table generated in steps 106 to 108. One way algorithms are well known in the art and are characterized by the fact that their operation is not reversible, i.e. there is no deterministic procedure to obtain the source values from the results of the operation. In the context of the present invention, this means that there is no way to compute a bootstrap value from its corresponding index value.

The well documented field of modern cryptography provides numerous examples of one way algorithm that can be used to compute the index value from a bootstrap, and thus these techniques will not be described here in more detail.

However the selection of a bootstrap for each index value in the look-up table requires a generation technique that will now be described. The technique, based on the simple mathematical operation called "Exclusive OR", is both efficient and easy to program. With the proposed technique, the index value is obtained by applying an "Exclusive OR" between two parts of the bootstrap, with each part being, for example, of a length twice the length of the index value. To generate a bootstrap that will yield the index after applying the "Exclusive OR" to its two parts, a random number generator is used. The first half of the bootstrap is a binary sequence generated randomly. To obtain the second half of the bootstrap, the first half is "Exclusive OR" with the index value itself. Because of the special properties of the "Exclusive OR", this will guarantee that the "Exclusive OR" of the two halves of the obtained bootstrap will produce the index value. And because more than one combination of two bootstrap halves could yield to the same index value, the number of combinations being depended of the length of the index value, there is no way to reverse the operation from the index value to the chosen bootstrap.

In order for the computer game to recognize the bootstrap that was selected for each index value in step 110, these bootstraps are stored with each corresponding entry in the look-up table. One skilled in the art will recognize that someone trying to guess a bootstrap for an index value will have to process by trial and error since only the pre-determined bootstrap value will be accepted by the computer game at playing time. One well versed in the art will also recognize that the chances of discovering a pre-determined bootstrap will decrease significantly as the length of the index value increases, and thus as the number of entries in the look-up table increases.

In step 112, initiator codes are generated. Each initiator code is in fact the conversion in readable format, such as, for example symbols, of the bootstrap for each valid entry in the look-up tables.

The symbols used to code the initiator code from the bootstraps may take many forms, including characters, letters, shapes, etc. Of course, the type of symbols used may vary from a computer game to another and may also depend on the position of the symbol itself in the code. This variety in the coding will render difficult the conversion from a bootstrap value that have been guessed by a player to a valid initiator code.

In step 114, a control number is generated for each valid entry in the look-up table that leads to a winning outcome when played. Each control number is generated independently from the initiator code, or any other value corresponding to the same entry in the look-up table. This control number will be used for validation purposes when the winning players claim their gains, and is stored along with the corresponding gain description in an outcome computer-readable database. Step 114 also produces the necessary data that is required to publish and distribute initiator codes to the players.

In step 116, the look-up table content is encrypted to preclude any individual from obtaining information that could allow playing the game for free. The encryption algorithm uses the bootstrap as an encryption key, hence varying the encryption from one entry to another in the look-up table and requiring the predetermined bootstrap of the entry to decrypt it. Known encryption algorithms, such as, for example, DES, could be used to protect the look-up table. However, they might not always be fitted as they impose certain lengths on the operands, the input and the output, and the encryption keys. An easy way to encrypt each entry of the table is to apply an "Exclusive OR" to each bit of the entry with each bit of the results of a one way operation on the bootstrap value. Digital digest algorithms, like MD5 or SHA, applied to the bootstrap provide good one way operation to generate apparently random string of bits. It is well known in the art of cryptography that an "Exclusive OR" with a random string of bits provides a robust method of encryption. Another advantage of this technique is that it can be used for any length the entries in the look-up table might have. To improve the protection, the digital digest algorithm could be applied successively numerous times, each time applying the algorithm on the output of the previous operation, starting with the bootstrap. This would lead to more apparent randomness in the string of bits to "Exclusive OR" with the entry, and significantly increase the time required to decrypt the table by "trial and error".

Although the above described method allows the lottery operator to generate a look-up table that provides game seed values only by providing the adequate initiator code, other methods can be used to link an initiator code both to the corresponding outcome and workflow, that, without departing from the spirit of the present invention. However, the techniques proposed by the invention takes good care in decreasing the possibilities that initiator codes could be guessed to play for fun. An important corollary of this advantage is that the chances of not detecting a keying error when the player supplies an authorized initiator code are also extremely low, thus reducing the risks of presentation of false outcomes to a legitimate player. This aspect will become more apparent upon reading the following description.

Alternatively, check bits can be added to the game seed values to conventionally provide further integrity and verification means.

Figure 2:
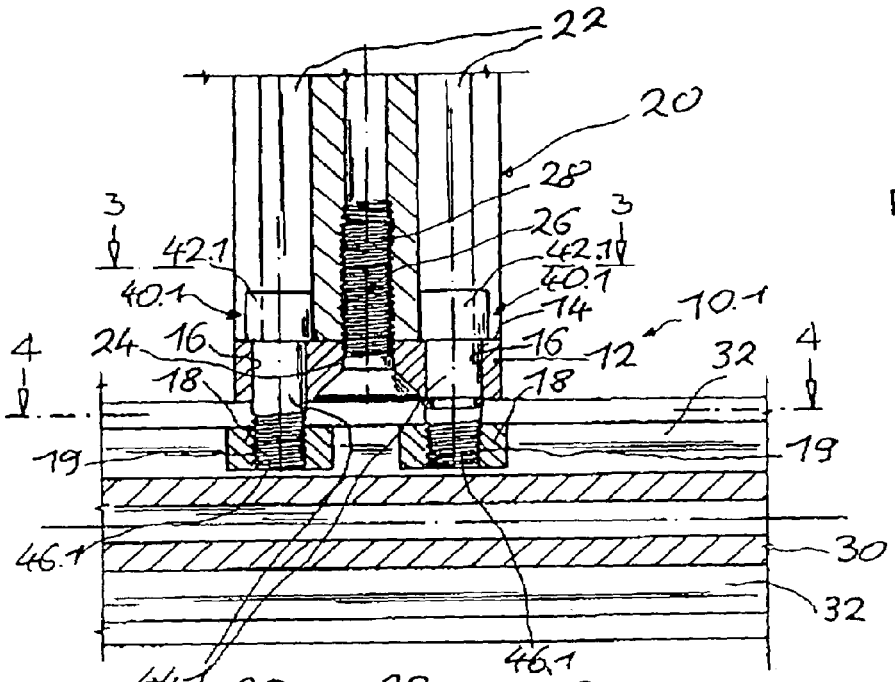
FIG. 2 is a block diagram of illustrating a method for playing a computer gambling game according to an embodiment of the present invention.

Turning now to FIG. 2 of the appended drawings, a method for playing a computer gambling game according to an embodiment of the present invention will be described.

Generally stated, the method for playing the computer gambling game consists in the execution of the following steps in sequence:

200—acquiring a computer program that embodies a computer game;

202—installing the computer program on a personal computer;

204—acquiring an initiator code;

206—initialization of the computer program;

208—playing the computer game; and

210—validation of the outcome of the computer game.

Each of these steps will now be described in more detail.

To play the computer gambling game, a copy of a computer game must be acquired from the lottery corporation (step 200). The computer game is issued by the lottery corporation in the form of a computer-readable media, such as, for example, a CD-ROM or a floppy disk. The computer program can be purchased via a standard lottery sales network. Alternatively, the computer program can also be given, by the lottery corporation, for example in the form of a computer freeware. indeed, since the sequence of game states and the outcome are determined by the initiator code, the player has to acquire an initiator code to successfully play the game. The operation of a lottery sales network is believed well known in the art and thus will not be described in more detail herein.

It is to be noted that the computer program that embodies the game can alternatively be distributed via a public computer network, such as, for example, the Internet or via a private dedicated computer network. The computer program can also be remotely executed via such a computer network. In other words, the nature of the medium used to store and/or distribute the computer game is not relevant to the present invention.

In the case of the distribution of the computer program via a computer readable media, the integrity of the distribution process may be increased by advantageously incorporating a check value that the computer program will verify before proceeding with the execution of the game.

As discussed hereinabove, look-up table may be included on the computer program or can be provided independently of the computer-readable media, for example through a computer network, such as, for example, the Internet. For concision and clarity purposes, the expression "computer program" will now include both the computer program and the look-up table.

The next step is to install the computer game on a personal computer (step 202). The personal computer (not shown) conventionally includes a central processing unit, input devices, such as, for example a mouse and a keyboard, an output device in the form of a display monitor, a storing device, for example in the form of a CD-ROM drive and optionally networking means that allows the personal computer to be connected to a computer network, such as, for example, the Internet.

This description does not limit the types and configuration of hardware and software used for playing the computer gambling game herein described. It is believed within the reach of someone skilled in the art to configure and/or program, well know devices and system such as, for example, WebTV™, laptop computers, network computers, PDA (Personal Digital Assistants), public access terminals and cellular phones, in order to play the computer gambling game according to the present invention.

It is to be noted that steps 200 and 202 can be advantageously performed altogether within a single operation if the computer program is downloaded from a computer network.

Among the installation parameters, the player may optionally be offered to install an access control routine to limit the access of the computer gambling game. This routine could, for example, prompt the player to enter an additional access code to play the computer game. This access code may then prevent other family members, such as, for example, children, to play the game.

The installation of a computer program on a personal computer is believed well known and will not be further described herein.

The acquisition of an initiator code by the player (step 204) may be done any time before step 206, which is the actual initialization of the computer game, as will be described in more detail below.

According to a first embodiment of the method for playing the computer gambling game, the initiator code is purchased in the form of an instant play lottery ticket 300 (FIGS. 3 to 6).

The computer program and an instant play lottery ticket can either be acquired together or separately without departing from the spirit of the present invention. Since the workflow, outcome and gains advantageously vary according to the initiator code provided on the instant play lottery ticket, supplemental lottery tickets may be purchased by the players who already own or have access to the computer game.

Figure 3:
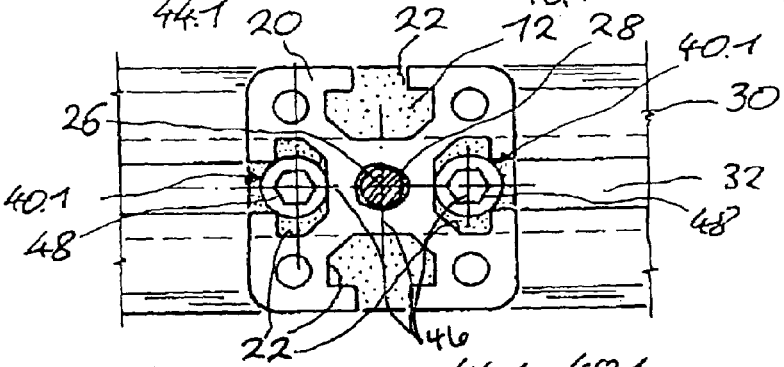
FIG. 3 is a schematic view of an instant lottery ticket according to a first embodiment of the present invention.
Figure 4:
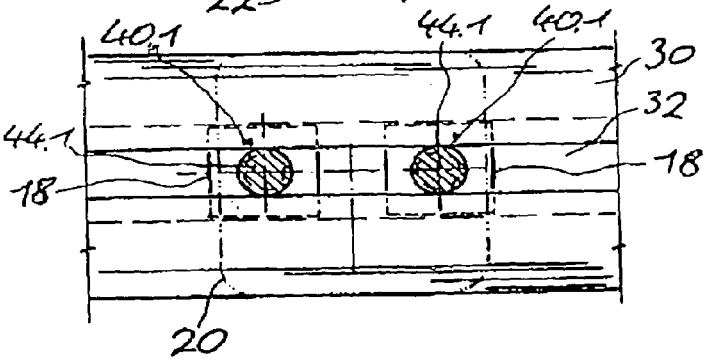
FIG. 4 is a schematic view of the instant lottery ticket of FIG. 3, with the latex coatings scratched off.

Turning now to FIGS. 3 and 4, a lottery ticket 300 according to a first ticket embodiment of the present invention will be described. The lottery ticket 300 is in the form of an instant play lottery ticket.

As can be seen in FIG. 3, the instant play lottery ticket 300 includes an initiator code zone 302, a bar code 304 and a validation zone 306. The initiator code zone 302 and the validation zone 306 are advantageously covered with a conventional latex coating that can be scratched off the ticket 300. The latex coating on the initiator code zone 302 is required to prevent the initiator code to be known to the user before the actual ticket purchase, while the latex coating on the validation zone 306 helps to prevent fraud since it covers the validation code (not shown), as will be discussed hereinbelow.

As can be seen in FIG. 4, illustrating the ticket 300 when the latex coating covering zone 302 has been scratched off, the initiator code zone 302 comprises the initiator code 308 in the form of a sequence of numbers. As will be explained in more detail hereinbelow, the initiator code 308 will be input into and translated by the computer program that embodies the game in order to play the computer game.

The bar code 304 and validation code present in the validation zone 306 are related to one of the control numbers generated in step 114 and thus uniquely identify the ticket 300.

While the bar code 304 is normally used to validate the outcome claimed by the player by using a conventional validation machine in connection with the lottery corporation databanks (step 210, FIG. 2), the validation code may alternatively be used to validate the outcome, for example, when such validation machine is defective or otherwise not available. A conventional notice may thus advantageously be written on the lottery ticket 300 to prevent the computer gambling game player from scratching the latex coating that covers the validation zone 306.

The general configuration of lottery tickets and the use of bar codes and validation numbers are believed well known in the art and will therefore not be described in more detail herein.

Figure 5:
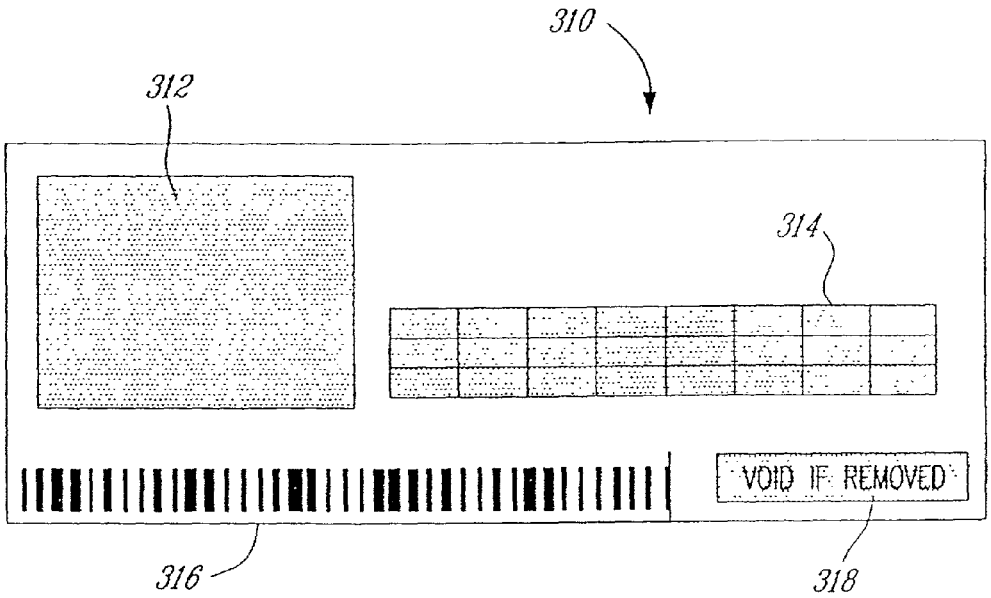
FIG. 5 is a schematic view of an instant lottery ticket according to a second embodiment of the present invention.
Figure 6:
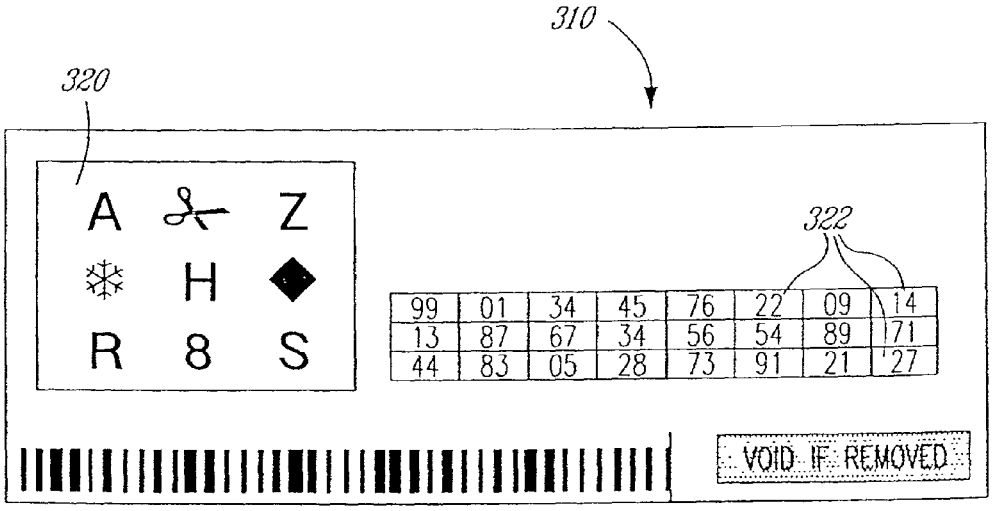
FIG. 6 is a schematic view of the instant lottery ticket of FIG. 5, with the latex coatings scratched off.

Turning now to FIGS. 5 and 6, an instant play lottery ticket 310 according to a second ticket embodiment of the present invention will be described. The instant play lottery ticket 310 includes first and second code zones 312 and 314, both covered by a latex coating, a bar code 316 and a validation zone 318. Since the instant play lottery ticket 310 is very similar to the instant play lottery ticket 300, only the differences therebetween will be further described.

As can be seen in FIG. 6, illustrating the ticket 310 when the latex coatings covering the first and second code zones 312 and 314 have been scratched off, the initiator code zones 312 and 314 comprise a plurality of symbols 320 and numbers 322. The symbols 320 are the initiator code and will thus be input into and translated by the computer program that embodies the game.

More specifically, the computer program first prompts the player to enter the symbols 320. Then, the computer game asks the user to scratch a portion of the latex coating of the code zone 314 to reveal one of the secondary codes 322. This number is entered into the computer program and compared with an expected value computed from the initiator code 320. If the two values match, the validation process is carried out. If not, the program stops. These supplemental numbers 322 are therefore advantageous since they make it more difficult to tabulate and distribute winning initiator codes so that players who want to play the computer gambling games only for fun without any gambling may do so. Indeed, since the computer game does not always ask for the same number, such a tabulation of winning outcomes would require the initiator code 320 and all the secondary codes 322.

Furthermore, the use of a plurality of code zones decreases the possibility of discovery by chance of an additional valid initiator code.

The minimum length of the initiator codes depends on the maximum number of initiator codes to be sold. For example, if the initiator codes are represented by 3 letters, only 17576 (26*26*26) different codes can be generated Alternatively, the same initiator code may be issued more than once. Evidently, two tickets having the same initiator code will provide the same outcome and the same sequence of game states, as discussed above.

The ticket surface may conventionally contain printed pictures or designs representing the game concept and thus allowing easy recognition of the gambling game while reducing the risk of fraud and error.

It is to be noted that each bar code (304 and 316) corresponds to a unique control number. However, as will now appear obvious to a person skilled in the art, one cannot obtain the initiator code or the game seed-outcome pair by knowing the control number since they are randomly associated by the process of step 114 (FIG. 1).

Returning to FIG. 2, the initialization of the computer program is performed in step 206. It is to be noted that, while the following description of the initialization step 206 will refer to the ticket illustrated in FIGS. 3 and 4, it is believed within the reach of someone skilled in the art to use the following teachings for the validation step 206, when other tickets are used, such as, for example, the ticket illustrated in FIGS. 5 and 6.

Step 206 includes the substeps of executing the computer program, providing the initiator code to the computer program, verifying the initiator code and searching the corresponding game seed-outcome pair in its look-up table.

More precisely, the player conventionally executes the computer program on a personal computer. The computer program then advantageously verifies the integrity of parameters, such as, for example, the look-up table.

The computer program then prompts the player to take the lottery ticket 300, to scratch the latex coating of the initiator code zone 302 and to enter the initiator code 308, using a conventional computer input means, such as, for example, a keyboard.

Then, the following substeps are performed by the computer game without notifying the player.

The symbols of the initiator code are converted into a bootstrap value which is a binary code as explained in step 112, FIG. 1. The resulting binary code may optionally include additional check bits to ensure that the code has been properly entered.

The bootstrap is then used by the computer program to compute the corresponding look-up table index, as described in step 110, FIG. 1. The encrypted look-up entry pointed by this index is then decrypted using the bootstrap as a decryption key, as explained in step 116, FIG. 1. If the value of the bootstrap coming from the ticket and the value of the bootstrap from the decrypted look-up table index are identical, the game seed-outcome pair is then read from the look-up table.

If the ticket bootstrap values and the index bootstrap values do not correspond, the computer program prompts the player to input the initiator code one more time according to the process discussed hereinabove. This prompt to the player will advantageously not give any indications of which symbols provided by the player are not part of the initiator code. Again, this shall help prevent the user from finding a valid initiator code by a trial and error process.

It is to be noted that an incorrect initiator code value, wrongly provided by the player or entered randomly for guessing purposes, will always produce an existing look-up table index value. The probability that the bootstrap value stored in the pointed look-up table entry (or randomly generated for invalid entries) corresponds to the bootstrap value of the initiator code depends on many factors, such as, for example, the algorithms used in steps 110 to 116 of the computer gambling game generation method of FIG. 1. It is believed within the reach of a person skilled in the art to select algorithms and length of values for the steps 110 to 116 that will minimize both the risk of invalid initiator codes not being detected and illegitimate initiator code being played.

An optional substep may be added in the initialization step 206, before the playing of the game. Indeed, the game may be simulated by the computer program to ensure that the game seed will correctly lead to the outcome optionally stored in the look-up table in step 104. The simulation will be done without displaying any of the usual graphical and sound references that come with most computer games. Conventional personal computers are believed powerful enough to perform such simulation in a relatively short time to thereby be transparent to the player. If the outcome of the simulated game does not correspond to the pre-defined outcome found in the look-up table entry, the computer program will consider the initiator code invalid and will prompt the player to re-enter the correct initiator code symbols.

In step 208, the computer program initiates the computer game by taking the game seed found in the just validated look-up table entry as a starting value for the computer game engine. As discussed earlier, this starting value will lead to the outcome that was stored with the game seed in the look-up table since this seed value was selected to correspond to the desired outcome in step 102.

Starting with the game seed, the computer program provides the player with the sequence of game states that will lead to the desired outcome. Depending on the computer game programmed, the player may interact with the computer game without changing the outcome. This is advantageous since it can simulate user's control over the game states even though the outcome is predetermined by the operator of the lottery.

At the end of the game (i.e. all the game states have been played by the computer program), the computer program indicates to the player the outcome of the game and optionally the gains that the player wins. The gains may take many forms, such as, for example, money, free initiator codes or extended play of the computer game. If the winning outcome corresponds to monetary gains, the computer program indicates to the player that the lottery ticket 300 must be conventionally validated in order to obtain the monetary gains.

To validate the winning outcome of the game (step 210), the player brings his instant play lottery ticket 300 to a lottery selling booth which is part of the lottery corporation network, such as, for example, a retail store that has been authorized by the lottery corporation to sell and validate lottery tickets. To validate the monetary gains claimed by the player, the instant play lottery ticket 300 is inserted in a validation terminal that reads the bar code 304. The validation terminal is remotely connected to the lottery corporation validation system. The bar code 304 on the instant play lottery ticket 300 is decoded in a binary value corresponding to the control number and is compared to the entries in the gains databases generated in step 114.

Alternatively, the latex coating of the validation zone 306 may be removed to reveal the validation code to determine if the ticket is a winner. In that case, the lottery ticket may be sent to the lottery corporation for later verification.

If the instant play lottery ticket 300 does not correspond to a winning outcome or if the bar code 304 is invalid or if the gains corresponding to the instant play lottery ticket 300 have already been claimed, a corresponding message is provided via the validation terminal.

If the lottery ticket corresponds to a winning outcome, the corresponding entry in the gains databases is marked as paid. This standard procedure prevents the lottery corporation from paying more than once for a winning ticket.

Configurations and operations of validation terminals and systems are believed well known to someone skilled in the art and thus will not be described in more detail herein.

A method for playing the computer gambling game according to a second embodiment of the present invention will now be described. Since this second embodiment is very similar to the first embodiment, only the differences therebetween will be described hereinafter.

The differences between the first and second embodiments are related to the acquisition of an initiator code (step 204) and the validation of the outcome of the computer game (step 210).

More specifically, according to the second embodiment of a method for playing the computer gambling game, the player purchases the initiator code first by creating an account on a computer network lottery site, such as, for example, the internet, and secondly, by downloading the bootstrap in the form of a binary code directly from the lottery site to his personal computer. Since, according to the second embodiment, bootstraps are read directly by the computer program, the conversion from a readable initiator code is not required.

The connection is preferably initiated by the computer program that has been advantageously provided with additional routines to execute the connection to the computer network and download automatically the computer game.

The computer program may either prompt the player to enter the information relative to the player's account or automatically send to the computer network this information that could have been previously entered into the computer.

The bootstrap is securely written on the client account file to provide a valid proof of purchase and game integrity. This account file would be made available to the player. Played bootstraps could optionally be marked in the database if the lottery operator must control winnings against published probabilities for the game.

According to this second embodiment, the bootstrap is taken randomly from a computer-readable database created during its computation in step 114, FIG. 1.

After the game, the outcome is immediately validated (step 210) and the corresponding gains (if any) are credited on the player's account. It is to be noted that, although the gains can be credited any time after the communication between the player's computer and the lottery site has been initiated, it is advantageous to wait until the end of the game to help keep the player's interest throughout the game. The money won by the player may eventually be used to buy other bootstraps. Different options could be offered to the player to receive his gains.

The confidentiality of the information transferred on computer networks is ensured by incorporating known data encryption methods.

Similarly, methods to credit the player's account through the network are believed well known in the art and therefore will not be described herein.

It is to be noted that the two embodiments of the method of playing the computer gambling game according to the present invention are not mutually excluding. Indeed, some initiator codes may be distributed on instant play lottery tickets, while others may be distributed via the computer network.

As can be seen hereinabove, a computer gambling game according to the present invention provides many possibilities regarding the type of computer game that can be played, without compromising the integrity and control of the lottery corporation that manages such gambling game. The use of a game seed that pre-defines both the outcome and the workflow of the game allows to control the number of wins and their nature. On the other hand, each game seed being determined independently of the number of game seeds or allowable gains, the use of an initiator code to select an independent game seed does not impose any limits on the number and nature of the initiator codes. This is advantageous as the initiator code format must be of a reasonable length since it is provided by the player. The game seed itself can be of any length and format to accommodate any type of game.

An advantage of encoding both the outcome and the workflow through the initiator code is that repeat customers will continue to feel excitement when playing the game since it will be difficult to predict the outcome by the workflow of the game. Indeed, since a particular winning outcome may be reached by many different game seed-outcome pairs by repeating the method of FIG. 1 while changing some of the parameters, the lifespan of a particular computer game is thereby increased. Furthermore, it will be possible for the lottery corporation to generate different sets of workflows.

Furthermore, preferred embodiments of the present invention include many features to help prevent fraud, errors, disputes and playing for fun, which could greatly impact the commercial aspect of the game. Examples of such features include:

- the analysis of the game seed values and initiator codes does not give any information regarding the game seeds and initiator codes generating processes;
- the initiator codes are only randomly related to the game seeds, and therefore their relation cannot be determined; and
- the relation between the game seed and the outcome is unidirectional and therefore one cannot determine the game seed by knowing the outcome of the game.

Moreover, preferred embodiments of the present invention present many advantages over the prior-art, including:

- help prevent the possibilities that a player misused initiator codes or find a valid initiator code by chance or fraud; and
- help prevent that differences occur between the outcome of the game as played and the predetermined outcome corresponding to the initiator code provided by the player.

Although the present invention has been described hereinabove by way of preferred embodiments thereof, it can be modified, without departing from the spirit and nature of the subject invention as defined in the appended claims.

What is claimed is:

1. A computer gambling game, comprising:

at least one initiator code related to an outcome and a game seed; and a computer program reading the game seed to generate sequences of games states;

wherein said sequences of game states are matched to the outcome to yield game outcome-game seed pairs, allowing that a predetermined outcome is reachable by a plurality of game seed-outcome pairs.

2. The computer gambling game as recited in claim 1, wherein the game seed is indexed in a look-up table and has an index value related to said at least one initiator code; said computer program retrieving the game seed by computing the index value using a related initiator code.

3. The computer gambling game as recited in claim 2, wherein said at least one initiator code is related to an index value using a one-way algorithm.

4. The computer gambling game as recited in claim 2, wherein said look-up table further includes at least one false entry.

5. The computer gambling game as recited in claim 2, wherein said look-up table is encrypted using an encryption algorithm.

6. The computer gambling game as recited in claim 5, wherein said encryption algorithm uses said at least one initiator code corresponding to said game seed as an encryption key.

7. The computer gambling game as recited in claim 2, wherein said look-up table also includes, for each index value, the predetermined outcome corresponding to its respective game seed; and said computer program simulates said sequence of game states corresponding to the at least one initiator code before executing said sequence of game states; said simulation of game states generating a simulated outcome; said computer programs executing said sequence of game states corresponding to the at least one initiator code if the simulated outcome corresponds to the predetermined outcome corresponding to the retrieved game seed.

8. The computer gambling game as recited in claim 2, wherein said look-up table also includes, for each index value, the initiator code corresponding to its respective game seed; said initiator code being compared to initiator codes in the look-up table; said computer program retrieving the game seed only if said initiator code corresponds to the initiator code in the look-up table corresponding to the retrieved game seed.

9. The computer gambling game as recited in claim 1, wherein said at least one initiator code is in the form of symbols printed on a lottery ticket.

10. The computer gambling game as recited in claim 9, wherein said lottery ticket is an instant play lottery ticket.

11. The computer gambling game as recited in claim 9, wherein said lottery ticket further includes a control number to validate the predetermined outcome corresponding to said initiator code provided on said lottery ticket.

12. The computer gambling game as recited in claim 1, wherein said computer program is written on a computer-readable media.

13. The computer gambling game as recited in claim 12, wherein said computer readable media is a CD-ROM.

14. The computer gambling game as recited in claim 1, wherein said computer program is downloaded via a computer network.

15. The computer gambling game as recited in claim 1, wherein said at least one initiator code is downloaded via a computer network.

16. The computer gambling game as recited in claim 1, wherein each sequence of game states defines an adventure game.

17. The computer gambling game as recited in claim 1, wherein each sequence of game states simulates a conventional casino game.

18. The computer gambling game as recited in claim 1, wherein each sequence of game states defines a gambling game.

19. The computer gambling game as recited in claim 1, wherein said at least one initiator code is randomly related to the game seed.

20. The computer gambling game as recited in claim 1, wherein said game seed and said outcome are linked by a unidirectional relation.

21. A method for playing a computer gambling game, comprising:

providing an initiator code related to a predetermined game outcome and game seeds;

acquiring a computer program that generates a plurality of sequences of game states from the game seeds;

installing the computer program on a personal computer;

running the computer program; and inputting the initiator code in the computer program;

whereby the computer program uses the initiator code to select sequences of game states that correspond to the predetermined game output and executes the selected sequences of game states to yield the predetermined game output.

22. The method for playing a computer gambling game as recited in claim 21, further comprising downloading via a computer network the initiator code from a lottery site before inputting the initiator code in the computer.

23. A computer-readable media to play a computer gambling game, comprising:

an initiator code related to a plurality of game seeds and predetermined game outcomes;

a computer program to execute a plurality of sequences of game states leading to one of the predetermined game outcomes; and a look-up table storing game outcome-game seed pairs.

24. A computer-readable media as recited in claim 23, wherein said look-up table is encrypted.

25. A method for generating a computer gambling game, said method comprising:

setting game parameters;

providing initiator codes related to game outcomes and game seeds;

providing a computer program, said computer program generating sequences of game states from the game seeds; and comparing the sequences of game states to the game parameters to yield game outcome-game seed pairs;

whereby a given game outcome is obtainable by a plurality of different sequences of game states.

26. The method for generating a computer gambling game as recited in claim 25, wherein said providing initiator codes comprises storing the initiator codes in a computer-readable database.

27. The method for generating a computer gambling game as recited in claim 25, wherein said comparing the sequences of game states to the game parameters to yield game outcome-game seed pairs comprises storing game seeds that correspond to a sequence of game states leading to one of the determined game outcomes in a look-up table.

28. The method for generating a computer gambling game as recited in claim 27 further comprising shuffling the game seeds before storing the game seeds in the look-up table.

29. The method for generating a computer gambling game as recited in claim 27, further comprising storing false entries in the look-up table.

30. The method for generating a computer gambling game as recited in claim 27, further comprising storing in the look-up table the determined game outcomes corresponding to their respective game seeds.

31. The method for generating a computer gambling game as recited in claim 27, further comprising:

indexing the game seeds in the look-up table and assigning an index value to each game seed; and relating a corresponding initiator code to the index value via a one-way algorithm.

32. The method for generating a computer gambling game as recited in claim 31, further comprising storing the corresponding initiator code in the look-up table.

33. The method for generating a computer gambling game as recited in claim 32, wherein said storing the corresponding initiator code comprises generating a corresponding initiator code in the form of a binary value; said method further comprising translating the initiator code in the form of symbols to be printed on an instant play lottery ticket.

34. The method for generating a computer gambling game as recited in claim 33, further comprising generating a control number to be printed on the lottery ticket for validating said predetermined outcome corresponding to the corresponding initiator code.

* * * * *